US011773857B2

(12) United States Patent
Lu et al.

(10) Patent No.: US 11,773,857 B2
(45) Date of Patent: Oct. 3, 2023

(54) DUAL ESP WITH SELECTABLE PUMPS

(71) Applicant: Baker Hughes, a GE Company, LLC, Houston, TX (US)

(72) Inventors: Xiao Nan Lu, Claremore, OK (US); Joseph Robert McManus, Claremore, OK (US); Howard Thompson, Claremore, OK (US); Zheng Ye, Claremore, OK (US); Risa Rutter, Claremore, OK (US)

(73) Assignee: Baker Hughes Holdings LLC, Houston, TX (US)

( * ) Notice: Subject to any disclaimer, the term of this patent is extended or adjusted under 35 U.S.C. 154(b) by 267 days.

(21) Appl. No.: 16/601,508

(22) Filed: Oct. 14, 2019

(65) Prior Publication Data

US 2020/0116154 A1 Apr. 16, 2020

Related U.S. Application Data

(60) Provisional application No. 62/744,981, filed on Oct. 12, 2018.

(51) Int. Cl.
*E21B 43/20* (2006.01)
*F04D 19/02* (2006.01)
*E21B 43/12* (2006.01)

(52) U.S. Cl.
CPC ..... *F04D 19/028* (2013.01); *E21B 43/12* (2013.01); *E21B 43/20* (2013.01)

(58) Field of Classification Search
CPC ..... E21B 21/08; E21B 43/12; E21B 43/20
(Continued)

(56) References Cited

U.S. PATENT DOCUMENTS 3,802,803 A 4/1974 Bogdanov et al.
3,918,830 A 11/1975 Schneider
(Continued)

FOREIGN PATENT DOCUMENTS

EP 0153079 A1 8/1985
GB 2549751 A 11/2017
(Continued)

OTHER PUBLICATIONS

International Search Report and Written Opinion issued in connection with corresponding PCT Application No. PCT/US2019/056156 dated Jan. 7, 2020.
(Continued)

*Primary Examiner* — Zakiya W Bates
*Assistant Examiner* — Ashish K Varma
(74) *Attorney, Agent, or Firm* — Crowe & Dunlevy, P.C.

(57) ABSTRACT

A pumping system includes a motor and a drive shaft configured for rotation by the motor. The pumping system includes an upper pump positioned above the motor, an upper pump shaft and an upper directional coupling connected between the drive shaft and the upper pump shaft. The upper directional coupling is configured to lock the upper pump shaft to the drive shaft when the drive shaft is rotated in a first direction. The pumping system further includes a lower pump positioned below the motor, a lower pump shaft, and a lower directional coupling connected between the drive shaft and the lower pump shaft. The lower directional coupling is configured to lock the lower pump shaft to the drive shaft when the drive shaft is rotated in a second direction.

9 Claims, 3 Drawing Sheets

(58) Field of Classification Search
USPC ..... 166/268
See application file for complete search history.

(56) References Cited

U.S. PATENT DOCUMENTS

| | | | | |
|---|---|---|---|---|
| 1,900,787 | A | 3/1977 | Baugnee | |
| 4,262,786 | A | 4/1981 | Taylor | |
| 4,330,740 | A | 5/1982 | Shell et al. | |
| 4,410,845 | A | 10/1983 | Lockyear | |
| 5,198,734 | A | 3/1993 | Johnson | |
| 5,350,242 | A | 9/1994 | Wenzel | |
| 6,113,355 | A | 9/2000 | Hult et al. | |
| 6,264,431 | B1 | 7/2001 | Triezenberg | |
| 6,325,143 | B1 * | 12/2001 | Scarsdale | E21B 43/128 166/54.1 |
| 6,369,534 | B1 | 4/2002 | Menegoli | |
| 6,388,353 | B1 | 5/2002 | Liu et al. | |
| 6,454,000 | B1 * | 9/2002 | Zupanick | E21B 47/09 166/241.1 |
| 6,598,681 | B1 | 7/2003 | Berry | |
| 6,798,338 | B1 | 9/2004 | Layton | |
| 6,940,249 | B2 | 9/2005 | Toyoda | |
| 7,170,262 | B2 | 1/2007 | Pettigrew | |
| 7,202,619 | B1 | 4/2007 | Fisher | |
| 7,330,779 | B2 | 2/2008 | Schulz | |
| 7,479,756 | B2 | 1/2009 | Kasunich et al. | |
| 7,971,650 | B2 | 7/2011 | Yuratich et al. | |
| 8,334,666 | B2 | 12/2012 | Plitt et al. | |
| 8,456,116 | B2 | 6/2013 | Burdick | |
| 8,624,530 | B2 | 1/2014 | Chung et al. | |
| 9,054,615 | B2 | 6/2015 | Head et al. | |
| 9,057,256 | B2 | 6/2015 | Ige et al. | |
| 9,061,751 | B2 | 6/2015 | Tanaka et al. | |
| 9,595,903 | B2 | 3/2017 | Hawes et al. | |
| 9,739,319 | B2 | 8/2017 | Aramoto et al. | |
| 9,777,540 | B2 | 10/2017 | Downie et al. | |
| 9,903,373 | B2 | 2/2018 | Hawes et al. | |
| 10,655,691 | B2 | 5/2020 | Iwano | |
| 10,903,715 | B2 | 1/2021 | Chelaidite et al. | |
| 2002/0056602 | A1 | 5/2002 | Aurora | |
| 2003/0085091 | A1 | 5/2003 | Ichihara et al. | |
| 2004/0262043 | A1 | 12/2004 | Schuaf | |
| 2006/0021841 | A1 | 2/2006 | Kimes et al. | |
| 2006/0185957 | A1 | 8/2006 | Kimes et al. | |
| 2007/0110593 | A1 | 5/2007 | Sheth et al. | |
| 2008/0078647 | A1 | 4/2008 | Watanabe et al. | |
| 2008/0179156 | A1 | 7/2008 | Byun | |
| 2008/0187444 | A1 | 8/2008 | Molotkov et al. | |
| 2009/0291001 | A1 | 11/2009 | Neuroth et al. | |
| 2010/0150751 | A1 | 6/2010 | Merrill et al. | |
| 2011/0033314 | A1 | 2/2011 | Plitt et al. | |
| 2011/0171047 | A1 | 7/2011 | Parmeter et al. | |
| 2013/0101447 | A1 | 4/2013 | Brown et al. | |
| 2013/0235494 | A1 | 9/2013 | Holce et al. | |
| 2013/0343933 | A1 | 12/2013 | Brown et al. | |
| 2014/0102721 | A1 | 4/2014 | Bespalov et al. | |
| 2014/0368143 | A1 | 12/2014 | Breitzmann et al. | |
| 2015/0114662 | A1 | 4/2015 | Hendryx | |
| 2015/0167657 | A1 | 6/2015 | Van Dam et al. | |
| 2015/0275581 | A1 | 10/2015 | Agarwal et al. | |
| 2015/0285319 | A1 | 10/2015 | Kawai et al. | |
| 2016/0123098 | A1 * | 5/2016 | Marr | E21B 21/00 175/57 |
| 2016/0186731 | A1 | 6/2016 | Meyer et al. | |
| 2017/0194831 | A1 * | 7/2017 | Marvel | H02K 7/14 |
| 2017/0306731 | A1 | 10/2017 | Xiao et al. | |
| 2018/0094512 | A1 | 4/2018 | Sadilek et al. | |
| 2018/0097466 | A1 | 4/2018 | Huh et al. | |
| 2018/0316240 | A1 | 11/2018 | Chelaidite et al. | |
| 2019/0323568 | A1 | 10/2019 | Uppal et al. | |
| 2020/0063541 | A1 | 2/2020 | Davis | |
| 2020/0116154 | A1 * | 4/2020 | Lu | F04D 13/021 |

FOREIGN PATENT DOCUMENTS

| | | | |
|---|---|---|---|
| JP | 2012162995 | A | 8/2012 |
| KR | 20060001231 | A | 1/2006 |
| KR | 100586150 | B1 | 6/2006 |
| KR | 101580526 | B1 | 12/2015 |
| RU | 2546685 | C2 | 4/2015 |
| WO | 2010030272 | A1 | 3/2010 |
| WO | 2014209127 | A1 | 12/2014 |

OTHER PUBLICATIONS

European Patent Office; Supplemental European Search Report; European Patent Application EP 19 87 1739; dated Jun. 22, 2022.
China Patent Office; Office Action for Application 201980077867.8; dated May 23, 2022 (with machine translation from Google Translate).

* cited by examiner

DUAL ESP WITH SELECTABLE PUMPS

RELATED APPLICATIONS

This application claims the benefit of U.S. Provisional Patent Application Ser. No. 62/744,981, filed Oct. 12, 2018 and entitled "Dual ESP With Selectable Pumps," the disclosure of which is herein incorporated by reference.

FIELD OF THE INVENTION

This invention relates generally to the field of submersible pumping systems, and more particularly, but not by way of limitation, to a submersible pumping system that can be remotely configured for operating under a wide variety of well production rates.

BACKGROUND

Submersible pumping systems are often deployed into wells to recover petroleum fluids from subterranean reservoirs. Typically, the submersible pumping system includes a number of components, including an electric motor filled with dielectric fluid coupled to a high performance pump located above the motor. The pump often includes a number of centrifugal stages that include a stationary diffuser and a rotatable impeller keyed to a shaft. When energized, the motor provides torque to the pump through the shaft to rotate the impellers, which impart kinetic energy to the fluid.

The pump and motor are sized, powered and configured for optimal operation within a defined range of wellbore conditions. For example, when a submersible pumping system is deployed into a newly completed well, the pump and motor may be sized and configured to produce a large volume of fluids. However, as the production rate of the well begins to decline or the gas-to-liquid ratio of the fluids in the well changes, the original motor and pump combination may be inefficient or unsuitable. In the past, the pumping system would be removed from the well and replaced or modified with a pump and motor combination that better fits the changing conditions in the wellbore. The process of removing and replacing the pumping system is labor intensive, expensive and requires the well to be placed offline for an extended period. There is, therefore, a need for an improved pumping system that can be remotely adjusted to accommodate a wide range of well production rates.

SUMMARY OF THE INVENTION

The present invention includes a pumping system for use in recovering fluids from a wellbore. The pumping system includes a motor and a drive shaft configured for rotation by the motor. The pumping system includes an upper pump positioned above the motor, an upper pump shaft and an upper directional coupling connected between the drive shaft and the upper pump shaft. The upper directional coupling is configured to lock the upper pump shaft to the drive shaft when the drive shaft is rotated in a first direction. The pumping system further includes a lower pump positioned below the motor, a lower pump shaft, and a lower directional coupling connected between the drive shaft and the lower pump shaft. The lower directional coupling is configured to lock the lower pump shaft to the drive shaft when the drive shaft is rotated in a second direction.

In another embodiment, the present invention includes a method for recovering fluids from a wellbore using a pumping system that includes a motor, an upper pump driven by the motor, a lower pump driven by the motor and production tubing extending out of the wellbore from the pumping system. The method includes the steps of rotating the motor in a first direction to drive only the lower pump, and rotating the motor in a second direction to drive only the upper pump.

WRITTEN DESCRIPTION

Figure 1:
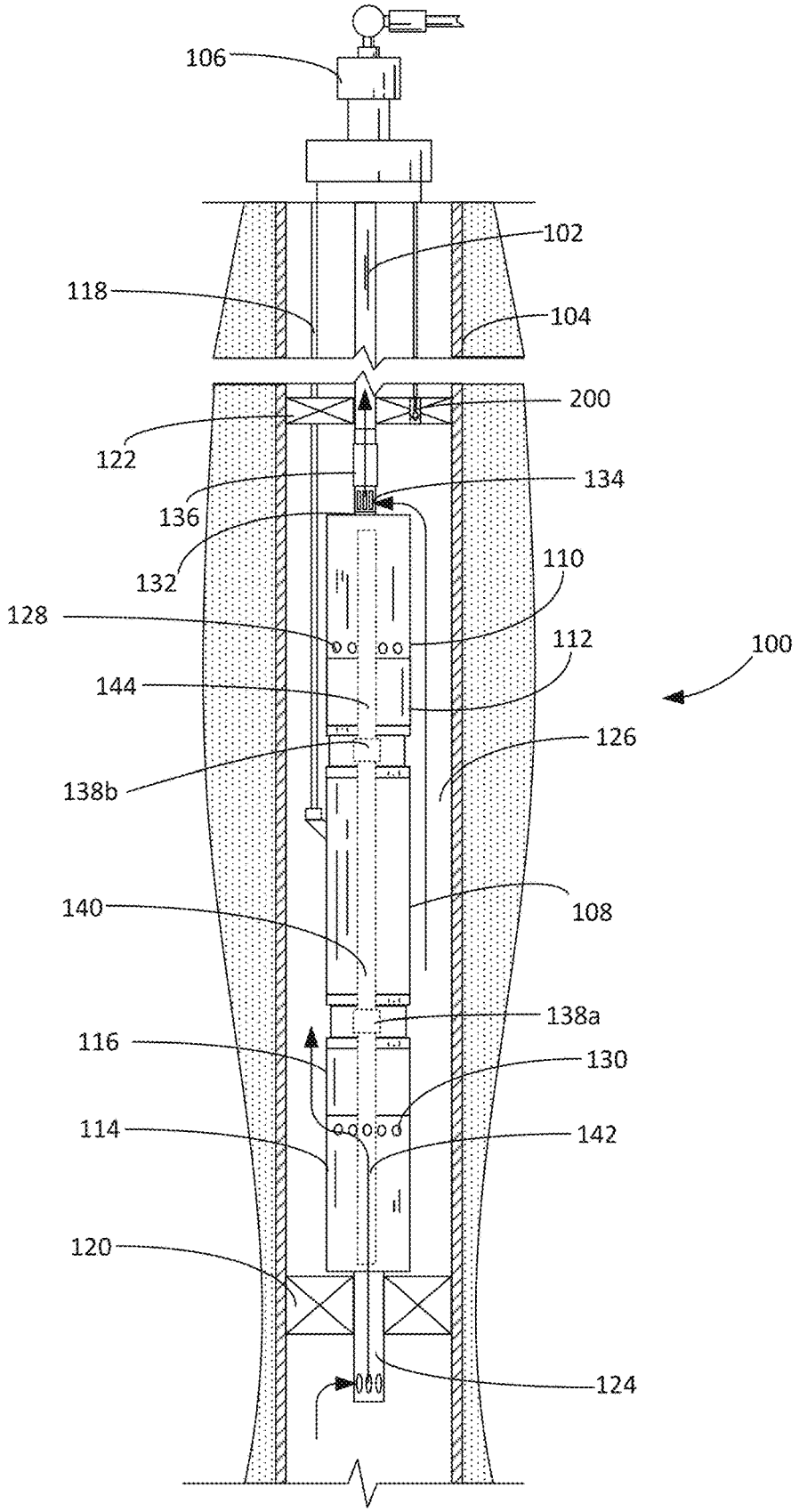
FIG. 1 depicts a submersible pumping system constructed in accordance with an exemplary embodiment of the present invention in a first mode of operation.

In accordance with exemplary embodiments of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations. As used herein, the term "petroleum" refers broadly to all mineral hydrocarbons, such as crude oil, gas and combinations of oil and gas.

It will be noted that although the pumping system 100 is depicted in a vertical deployment in FIG. 1, the pumping system 100 can also be used in non-vertical applications, including in horizontal and non-vertical wellbores 104. Accordingly, references to "upper" and "lower" within this disclosure are merely used to describe the relative positions of components within the pumping system 100 and should not be construed as an indication that the pumping system 100 must be deployed in a vertical orientation.

As depicted in FIG. 1, the pumping system 100 includes a motor 108, an upper pump 110 and an upper seal section 112 positioned between the motor 108 and the upper pump 110. The pumping system 100 also includes a lower pump 114 and a lower seal section 116 positioned between the lower pump 114 and the motor 108. The upper and lower seal sections 112, 116 are designed to isolate the motor 108 from wellbore fluids in the upper and lower pumps 110, 114 and may be configured to accommodate the expansion of motor lubricants in the motor 108. The upper and lower seal sections 112, 116 may also include thrust bearings that protect the motor 108 from axial thrust generated by the upper and lower pumps 110, 114.

The motor 110 receives power from a surface-based facility through power cable 118. Generally, the motor 110 is configured to selectively drive either the upper pump 110 or the lower pump 114. In some embodiments, one or both of the upper pump 110 and lower pump 114 are turbomachines that use one or more impellers and diffusers to convert mechanical energy into pressure head. In alternate embodiments, one or both of the upper pump 110 and lower pump 114 are positive displacement pumps. In some embodiments, one of the upper and lower pumps 110, 114 is a positive displacement pump and the other of the upper and lower pumps 110, 114 is a turbomachinery (e.g., centrifugal) pump.

Figure 5:
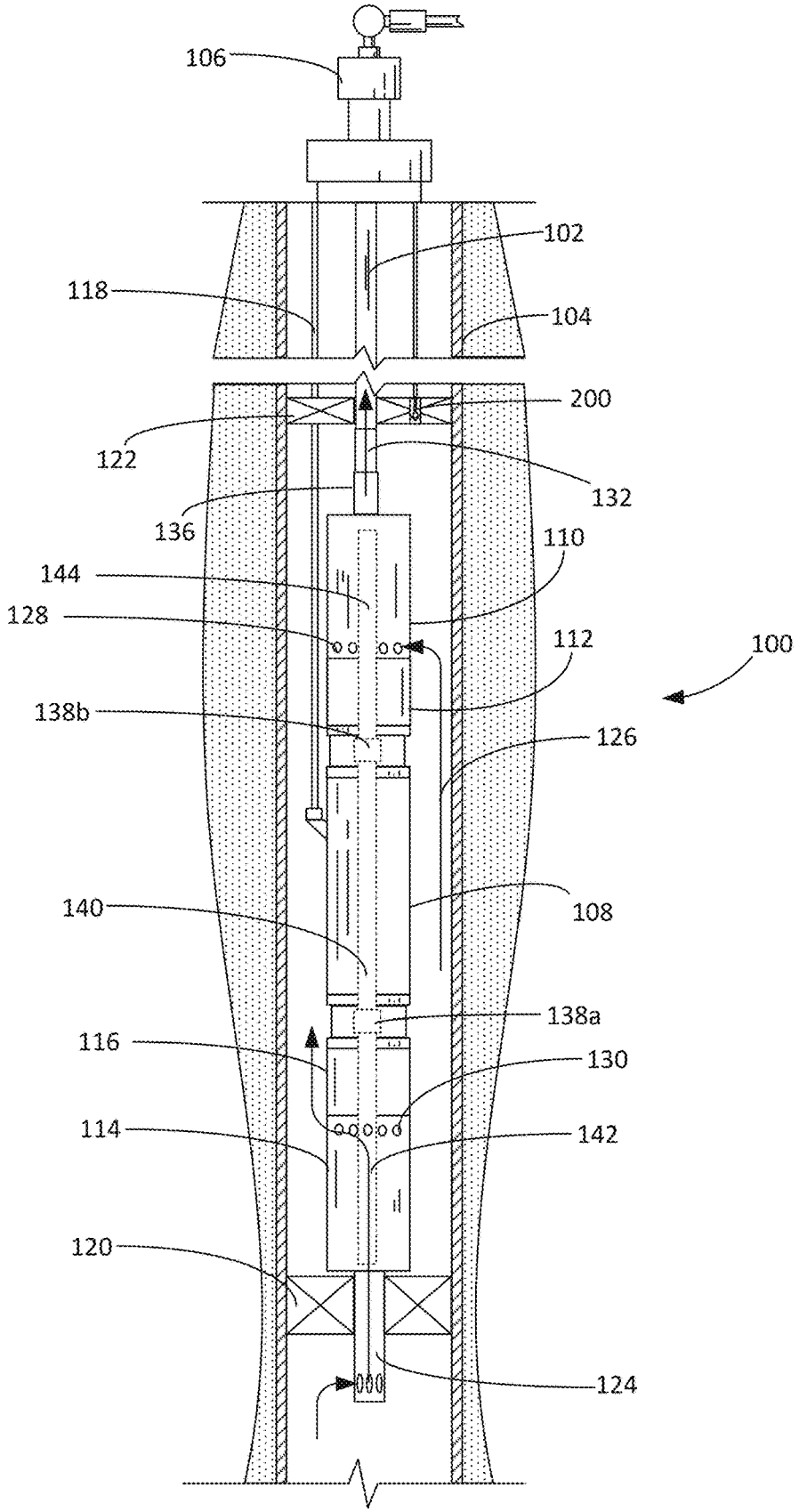
FIG. 5 depicts a submersible pumping system constructed in accordance with an exemplary embodiment of the present invention in a first mode of operation.

Although the present invention is not so limited, the pumping system 100 in FIG. 1 includes a lower packer 120 and an upper packer 122. An inlet pipe 124 extends from the lower pump 114 through the lower packer 120. The inlet pipe 124 provides an intake to the lower pump 114. The production tubing 102 and power cable 118 extend through the upper packer 122. The lower packer 120 and upper packer 122 together create a contained annular space 126 around the pumping system 100. The upper packer 122 may include a gas relief valve 200 that can be remotely actuated to release accumulated gas pressure within the annular space 126. Although the pumping system 100 is depicted in FIGS. 1 and 5 as deployed in the wellbore 104 with the upper and lower packers 120, 122, it will appreciated that the pumping system 100 can also be deployed in other arrangements, including in combination with shrouds and single packer embodiments.

The lower pump 114 includes a lower pump discharge 130 that is configured to discharge pumped fluid into the annular space 126. The upper pump 110 includes an upper pump intake 128 and an upper pump discharge 132 that includes a selectable inlet 134 that cooperates with a fluid diverter 136 to direct pressurized fluid into the production tubing 102. As depicted in FIG. 1, the fluid diverter 136 is a sliding sleeve that is in an open position in which pressurized fluid from the annular space 126 can pass into the production tubing 102 through the selectable inlet 134. In FIG. 5, the fluid diverter 136 has been shifted into a closed position in which the selectable inlet 134 is closed to the fluid in the annular space 126. In this position, the upper pump discharge 132 places the production tubing 102 in direct fluid communication with the upper pump 110.

The pumping system 100 includes one or more directional couplings 138 that selectively couple the output from the motor 108 to the upper and lower pumps 110, 114. As depicted, the pumping system 100 includes a lower directional coupling 138*a* and an upper directional coupling 138*b*. The motor 108 includes a drive shaft 140 that is directly or indirectly connected to a lower pump shaft 142 in the lower pump 114 through the lower directional coupling 138*a*. The drive shaft 140 is directly or indirectly connected to an upper pump shaft 144 through the upper directional coupling 138*b*. It will be appreciated that the drive shaft 140 may be composed of separated, independent shaft segments that extend from the top and bottom of the motor 108.

In exemplary embodiments, the directional couplings 138*a*, 138*b* are configured to selectively pass torque from the drive shaft 140 to either the upper pump shaft 142 or the lower pump shaft 144 depending on the rotational direction of the drive shaft 140. Rotating the drive shaft 140 in a first direction locks the lower directional coupling 138*a* with the lower pump shaft 142 to drive the lower pump 114, while maintaining the upper directional coupling 138*b* in an unlocked condition in which the upper pump shaft 144 is idled. Conversely, rotating the drive shaft 140 in a second direction locks the upper directional coupling 138*b* with the upper pump shaft 144 to drive the upper pump 110, while maintaining the lower directional coupling 138*b* in an unlocked condition in which the lower pump shaft 142 is idled. Thus, changing the rotational direction of the motor 108 causes either the upper pump 110 or the lower pump 114 to be driven by the motor 108. Because the upper and lower pumps 110, 114 are selectively engaged by changing the rotational direction of the motor 108, impellers and diffusers within the upper and lower pumps 110, 114 should be configured with either standard or reverse vane designs depending on the intended rotational direction of the lower and upper pump shafts 142, 144.

Figure 2:
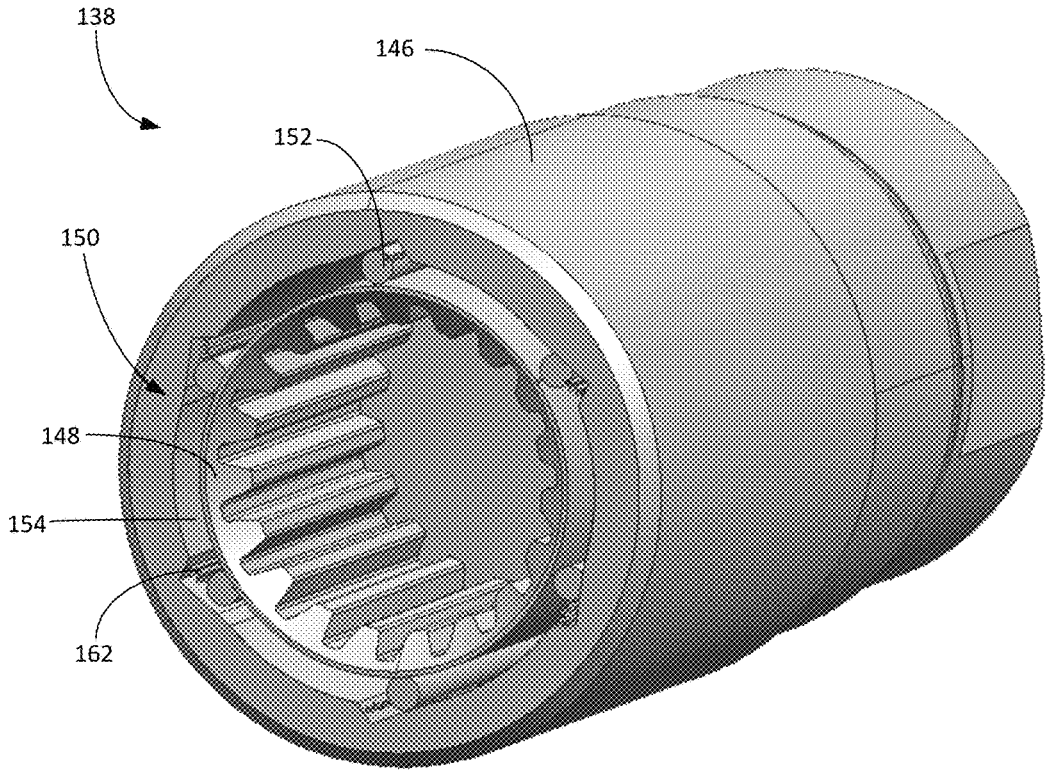
FIG. 2 presents a perspective view of a directional coupling from the pumping system of FIG. 1.
Figure 3:
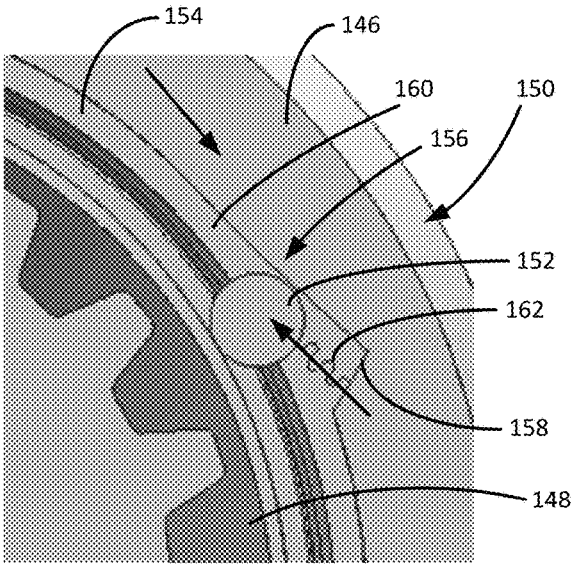
FIG. 3 presents a close-up view of the directional coupling illustrating the outer drive body rotated in a direction that engages the locking mechanism to rotate the auxiliary receiver.
Figure 4:
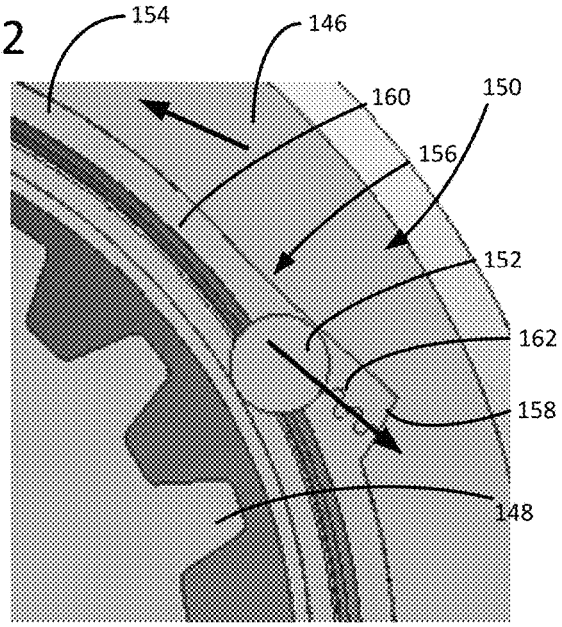
FIG. 4 presents a close-up view of the directional coupling illustrating the outer drive body rotated in a direction that disengages the locking mechanism to idle the auxiliary receiver.

Turning to FIGS. 2-4, shown therein are depictions of an exemplary embodiment of the directional coupling 138. The directional coupling 138 includes an outer drive body 146, an inner receiver 148 and a locking mechanism 150. The outer drive body 146 is configured to be locked for rotation with the drive shaft 140. The outer drive body 146 and drive shaft 140 can be coupled together using splines, pins, threaded or other connections known in the art.

The inner receiver 148 is configured to be coupled with either the lower pump shaft 142 or the upper pump shaft 144. As depicted in FIGS. 2-4, the inner receiver 148 includes a series of splines that are configured to engage with the splined end of the lower and upper pump shafts 142, 144. When the locking mechanism 150 is not engaged, the inner receiver 148 is configured to rotate freely within the outer drive body 146. In some embodiments, hydrodynamic, ball or other bearings are used to facilitate the rotation of the inner receiver 148 within the outer drive body 146.

The locking mechanism 150 is configured to couple the outer drive body 146 to the inner receiver 148 when the outer drive body 146 is rotated in a first direction, while permitting the inner receiver 148 to spin freely within the outer drive body 146 when the outer drive body 146 is rotated in a second direction. In the exemplary embodiment depicted in FIGS. 2-4, the locking mechanism 150 includes a plurality of roller pins 152 and a track 154 that includes a series of tapered portions 156 that each extend from a recess 158 to a throat 160. The roller pins 152 are located in the track 154 and permitted to shift between the recess 158 and the throat 160 within the tapered portions 156. As depicted in FIG. 3, when the outer drive body 146 is rotated in a first direction, the roller pins 152 are pressed into the throat 160, where the frictional contact between the outer drive body 146, the roller pins 152 and the inner receiver 148 lock the outside drive body 146 and inner receiver 148 together in rotation. Locking springs 162 can be used to keep the roller pins 152 in the locked position as torque fluctuates through the directional coupling 138.

In FIG. 4, the outer drive body 146 is being rotated in a second direction in which the roller pins 152 are being urged out of the throat 160 toward the recess 158 by the rotation of the outer drive body 146 with respect to the inner receiver 148, thereby decoupling the outer drive body 146 from the inner receiver 148. In the position depicted in FIG. 4, torque supplied to the outer drive body 146 would not be passed through the directional coupling 138 to the upper or lower pump shaft 142, 144 connected to the inner receiver 148.

With the directional couplings 138, the pumping system 100 is capable of selectively shifting between the use of the upper pump 110 and the lower pump 114 by changing the rotational direction of the motor 108 to optimize the removal of fluids from the wellbore 104. As a non-limiting example, the pumping system 100 can be placed into a first mode of operation by rotating the motor 108 in a first direction to drive the lower pump 114 through the directional coupling 138*a* while keeping the upper pump 110 decoupled from the motor 108 (as depicted in FIG. 1). The lower pump 114 may be configured to produce an increased volume of fluid present at an early stage in the production from the wellbore 104. When the conditions in the wellbore 104 change, the pumping system 100 can be placed into a second mode of operation by switching the rotational direction of the motor 108 to idle the lower pump 114 and drive the upper pump 110 through the upper directional coupling 138*b* (as depicted in FIG. 5). It may be desirable to open the gas relief valve 200 when the gas-to-liquid ratio increases with declining liquid production to enhance recovery through the upper pump 110.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A pumping system for use in recovering fluids from a wellbore, the pumping system comprising:

a motor;

a drive shaft configured for rotation by the motor;

an upper pump positioned above the motor, wherein the upper pump includes an upper pump shaft;

an upper directional coupling connected between the drive shaft and the upper pump shaft, wherein the upper directional coupling is configured to lock the upper pump shaft to the drive shaft when the drive shaft is rotated in a first direction;

a lower pump positioned below the motor, wherein the lower pump includes a lower pump shaft; and a lower directional coupling connected between the drive shaft and the lower pump shaft, wherein the lower directional coupling is configured to lock the lower pump shaft to the drive shaft when the drive shaft is rotated in a second direction.

2. The pumping system of claim 1, wherein the upper directional coupling and the lower directional coupling each comprise:

an outer drive body, wherein the outer drive body is configured for rotation with the drive shaft;

a locking mechanism; and an inner receiver.

3. The pumping system of claim 2, wherein the locking mechanism comprises a track that includes a plurality of tapered portions, wherein each of the tapered portions includes a recess and a throat.

4. The pumping system of claim 3, wherein the locking mechanism comprises a plurality of roller pins located within the track.

5. The pumping system of claim 4, wherein the locking mechanism of the upper directional coupling is configured such that the roller pins lock the inner receiver with the outer drive body when the motor, drive shaft and outer drive body are rotated in the first direction.

6. The pumping system of claim 4, wherein the locking mechanism of the lower directional coupling is configured such that the roller pins lock the inner receiver with the outer drive body when the motor, drive shaft and outer drive body are rotated in the second direction.

7. The pumping system of claim 1, further comprising an upper packer and a lower packer that together define an annular space between the wellbore and the pumping system.

8. The pumping system of claim 7, wherein the lower pump further comprises an inlet pipe that extends through the lower packer.

9. The pumping system of claim 7, wherein the upper pump further comprises:

an upper discharge; and a selectable inlet, wherein the selectable inlet comprises a sliding sleeve.

* * * * *